US006551129B2

(12) United States Patent
Kato

(10) Patent No.: US 6,551,129 B2
(45) Date of Patent: Apr. 22, 2003

(54) GROUND CONNECTOR

(75) Inventor: Koichi Kato, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/972,248

(22) Filed: Oct. 9, 2001

(65) Prior Publication Data

US 2002/0042216 A1 Apr. 11, 2002

(30) Foreign Application Priority Data

Oct. 11, 2000 (JP) ..... 2000-310147

(51) Int. Cl.[7] ..... H01R 13/643
(52) U.S. Cl. ..... 439/497; 439/395; 439/404
(58) Field of Search ..... 439/498, 395, 439/397, 399, 400, 401, 402, 403, 404

(56) References Cited

U.S. PATENT DOCUMENTS 4,027,941 A * 6/1977 Narozny ..... 339/14 R
5,766,033 A 6/1998 Davis ..... 439/405
5,768,766 A 6/1998 Hatagishi et al. ..... 29/753
6,146,185 A * 11/2000 Cole et al. ..... 439/399

FOREIGN PATENT DOCUMENTS

JP 6-044034 6/1994

* cited by examiner

*Primary Examiner*—P. Austin Bradley
*Assistant Examiner*—Alexander Gilman
(74) *Attorney, Agent, or Firm*—Greenblum & Bernstein, P.L.C.

(57) ABSTRACT

A ground connector is made of a conductive flat plate having a first side section, a second side section, a central foldable section between the first and second side sections, and a ground terminal. The first side section is configured to serve as a base plate member. The second side section is configured to serve as a cover plate member that presses the electric wires when the conductive flat plate is folded with respect to the central foldable section. The base plate member is provided unitarily and in one piece with a plurality of insulation displacement terminals. The cover plate member is provided with a plurality of receiving apertures each corresponding to each of the insulation displacement terminals. The electric wires are placed on the insulation displacement terminals. Then, the cover plate member is folded over the base plate member with respect to the central foldable section so that the insulation displacement terminals enter the respective receiving apertures, thereby connecting the electric wires to the respective insulation displacement terminals.

6 Claims, 9 Drawing Sheets

GROUND CONNECTOR

BACKGROUND OF THE INVENTION

1. Field of the Invention

This invention relates to a ground connector by which a plurality of electric wires for a ground circuit are connected together to the ground at their ends, and more particularly relates to a ground connector which is made of a single component.

2. Description of Background Information

Heretofore, a ground connector has been used in an automotive vehicle in order to connect together a plurality of electric wires in wire harnesses to a ground side such as a vehicle body.

For convenience of explanation, a conventional ground connector will be described by referring to FIGS. 8 and 9. FIG. 8 is a perspective view of a conventional ground connector. FIG. 9 is a cross section view of the conventional ground connector, illustrating an electric wire in insulation displacement connection onto the connector.

As shown in FIG. 8, a ground connector 51 disclosed in Japanese Utility Model Public Disclosure No. HEI 6-44034 (1994) comprises two components, namely a joint base bar 52 made of a conductive material and a wire holder 53 made of an insulation resin material. The joint base bar 52 has a plurality of slots 52*a* for applying insulation displacement to electric wires W. The wire holder 53 has a plurality of grooves 53*a* for receiving the electric wires W.

As shown in FIG. 9, after the electric wires W are inserted into the grooves 53*a* in the wire holder 53 of the ground connector 51, the joint base bar 52 is attached to the wire holder 53. Each slot 52*a* in the joint base bar 52 bites into an insulation sheath Wb of each of the electric wires W, thereby connecting the joint base bar 52 to a core element Wa in the electric wire W in an insulation displacement manner. Then, a ground terminal 54 formed on the joint base bar 52 is secured to a vehicle body. Consequently, all of the electric wires W are grounded.

However, since the ground connector 51 comprises two components, that is, the joint base bar 52 and the wire holder 53 and the joint base bar 52 is not coupled to the wire holder 53 before the electric wires W are passed through the wire holder 53, control of the parts is a problem. In addition, since the electric wires W are connected only to slots in the joint base bar in an insulation displacement manner, the electric wires W will come out of the slots when the electric wires W are pulled in a longitudinal direction.

SUMMARY OF THE INVENTION

An object of the present invention is to provide a ground connector which is constructed from a single component and can prevent electric wires from coming out of the connector even though a tensile force is applied to the electric wires.

In order to achieve the above object, a ground connector in accordance with the present invention is made of a conductive flat plate having a first side section, a second side section, a central foldable section between the first and second side sections, and a ground terminal. The first side section is configured to serve as a base plate member. The second side section is configured to serve as a cover plate member for pressing the electric wires when the conductive flat plate is folded with respect to the central foldable section. The base plate member is formed unitarily and in one piece with a plurality of insulation displacement terminals. The cover plate member is provided with a plurality of receiving apertures each corresponding to a respective one of the insulation displacement terminals. The electric wires are placed on the insulation displacement terminals. Then, the cover plate member is folded over the base plate member with respect to the central foldable section so that the insulation displacement terminals enter the respective receiving apertures, thereby connecting the electric wires to the respective insulation displacement terminals.

Since in the ground connector in accordance with the present invention the base plate member provide with insulation displacement terminals and the cover plate member for holding the electric wires are made of a sheet of a conductive plate, the connector has only one component.

Although the conductive plate is formed by punching a conductive metal plate, it may also be made of a high conductive resin material.

In a further aspect of the present invention, in the ground connector according to the present invention, the base plate member is further provided with a plurality of wire holders each corresponding to and being spaced from each of said insulation displacement terminals. Each wire holder has substantially the same configuration as that of each insulation displacement terminal. The insulation displacement terminals and wire holders are formed by cutting and raising certain portions of the conductive plate. Each insulation displacement terminal is disposed in series with each corresponding wire holder and the insulation displacement terminals and wire holders are juxtaposed, respectively. The cover plate member is provided with a plurality of receiving apertures corresponding to the insulation displacement terminals and wire holders. The insulation displacement terminals and wire holders are provided at their upper ends with wire insertion slots, and a pair of pieces which define each of the wire insertion slots are provided on opposite outer side surfaces with lock projections. The insulation displacement terminals and wire holders are inserted into the receiving apertures while deflecting the lock projections inwardly. Inner peripheral edges on the slots in the insulation displacement terminals come into contact with core elements in the electric wires upon deflection of the pieces of the insulation displacement terminals, while the inner peripheral edges on the slots in the wire holders bite into sheaths of the electric wires to hold the electric wires.

According to the above construction, each electric wire is connected to each insulation displacement terminal in an insulation displacement manner and is held in each slot in the wire holder so that the inner edge of the slot bites the insulation sheath of the electric wire. Since each electric wire is held at two positions, any tensile force cannot draw the electric wire out of the connector.

Also, each insulation displacement terminal and each wire holder have lock projections and the lock projections engage the cover plate member around the peripheries of the receiving apertures. Consequently, it is possible to positively hold the cover plate member and to firmly press the electric wires by means of the cover plate member.

The ground terminal is formed by cutting a central portion of the central foldable section. The ground terminal is connected to the base plate member at the proximal end thereof. The ground terminal projects from the central foldable section when the cover plate member is folded over the base plate member with respect to the central foldable section.

This requires no ground terminal which projects from an end of a conductive plate. Accordingly, the conductive plate can be formed into a rectangular shape, thereby reducing the cost of material.

BRIEF DESCRIPTION OF THE DRAWINGS

The foregoing and other features of the present invention will become apparent to one skilled in the art to which the present invention relates upon consideration of the invention with reference to the accompanying drawings, wherein.

DETAILED DESCRIPTION OF THE PREFERRED EMBODIMENTS

Figure 1:
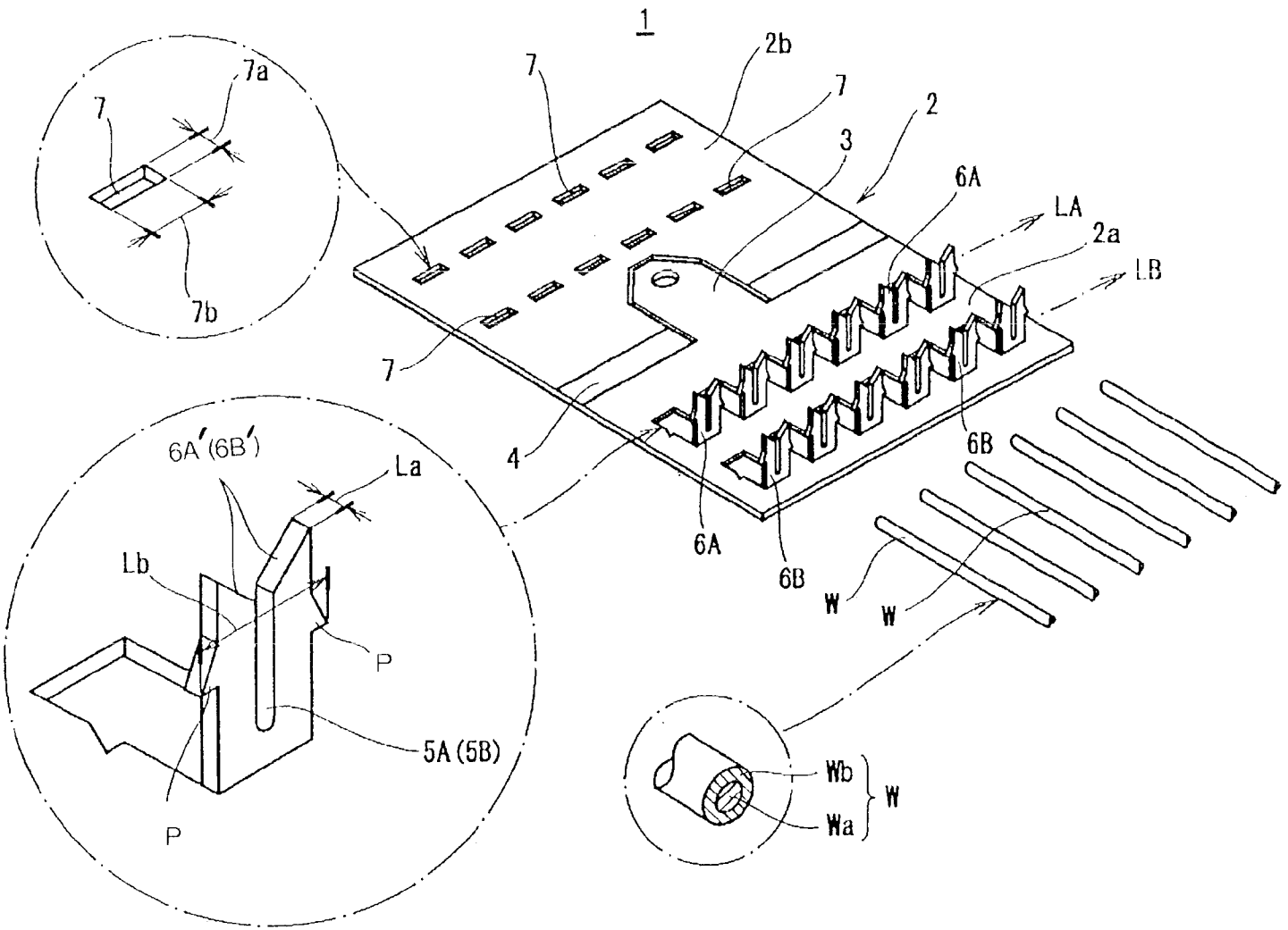
FIG. 1 is a perspective view of an embodiment of a ground connector in accordance with the present invention.

Embodiments of a ground connector in accordance with the present invention will be described below by referring to the drawings.

In FIG. 1, a ground connector 1 in an embodiment of the present invention is used to connect together a plurality of electric wires W in wire harnesses in an automotive vehicle to a ground side such as a vehicle body.

The ground connector 1 is a single component made of a rectangular conductive plate 2. The conductive plate 2 is formed unitarily and in one piece from any suitable electrically conductive material, such as metal or conductive resin material. The conductive plate 2 includes a first side section which serves as a base plate member 2*a*, a second side section which serves as a cover plate member 2*b*, a central foldable section 4 between the first and second side sections, and a ground terminal 3 provided integrally on a central portion of the foldable section 4.

A plurality of insulation displacement terminals 6A are provided on the base plate member 2*a* by cutting and raising certain portions of the conductive plate 2 so that the terminals 6A are juxtaposed on the member 2*a*. Similarly, a plurality of wire holders 6B are provided on the base plate member 2*a* by cutting and raising certain portions of the conductive plate 2 so that the wire holders 6B are juxtaposed to each other and disposed in series with the terminals 6A on the member 2*a*.

Each insulation displacement terminal 6A has substantially the same configuration as that of each wire holder 6B. The insulation displacement terminals 6A and wire holders 6B are provided with slots 5A and 5B through their upper ends and on their upper inner ends with slant surfaces 6A' and 6B', respectively. The slant surfaces 6A' and 6B' are formed on the opposite sides of the slots 5A and 5B, respectively so that the respective slant surfaces 6A' and 6B' enlarge the inlets of the respective slots 5A and 5B. The insulation displacement terminal 6A and wire holder 6B are provided on their outer side surfaces with lock projections P.

Figure 4A:
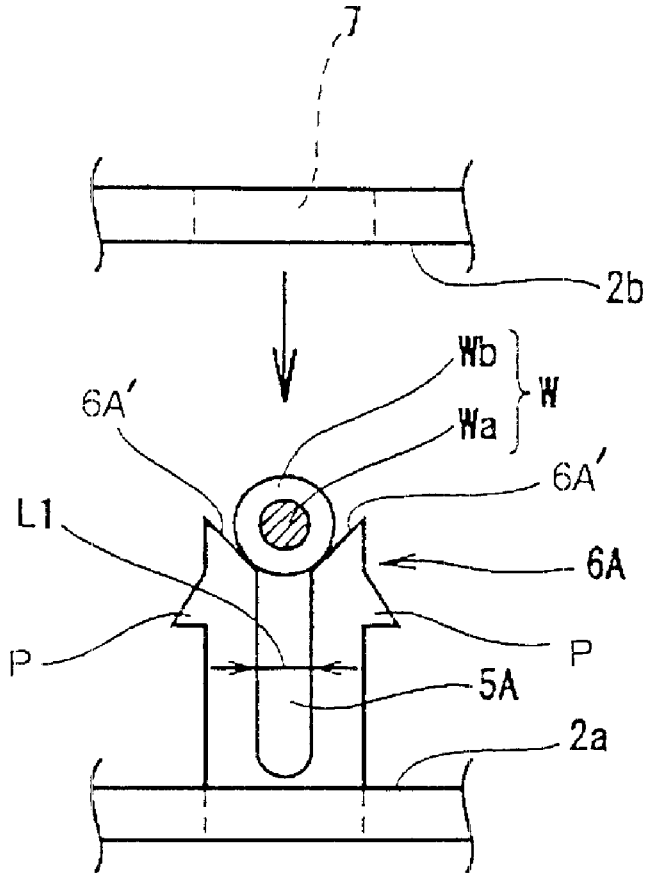
FIGS. 4A and 4B are front elevation views, illustrating an operation of installing an electric wire onto an insulation displacement terminal.
Figure 4B:
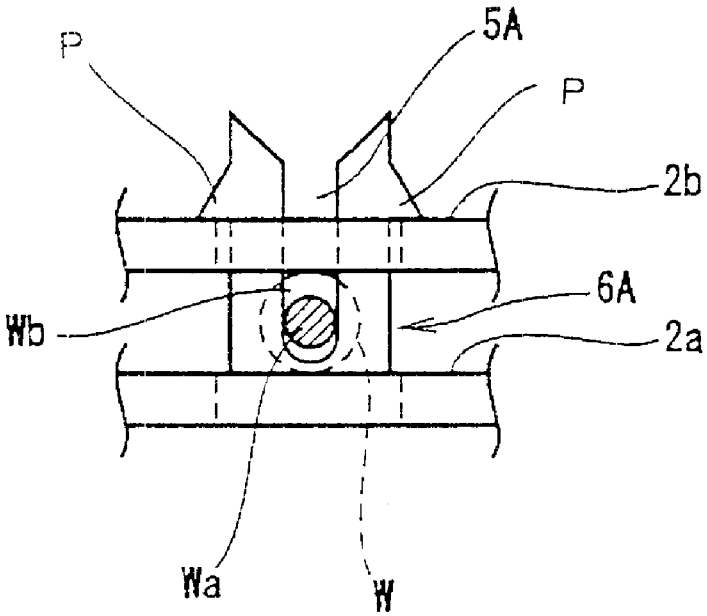
Figure 5A:
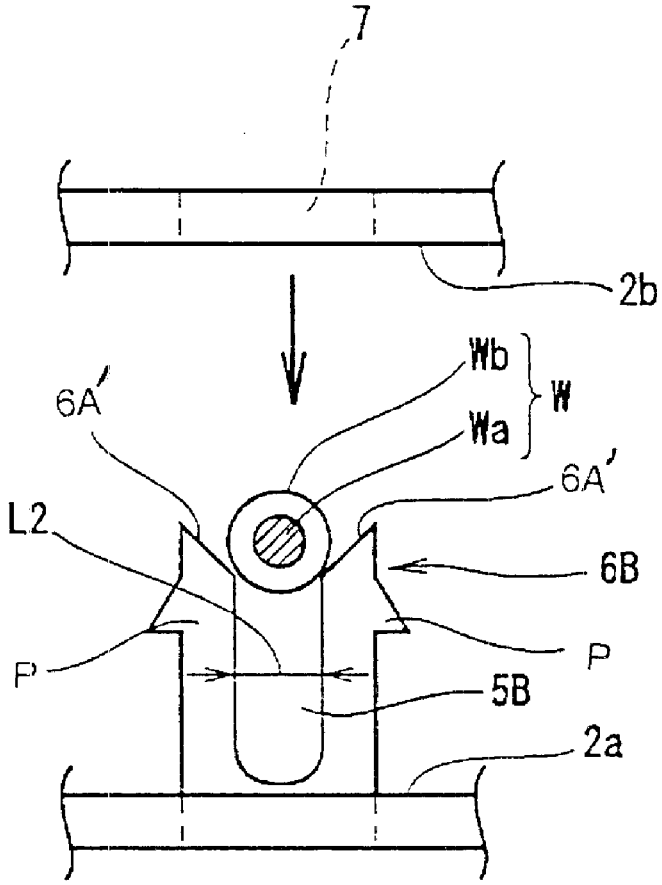
FIGS. 5A and 5B are front elevation views, illustrating an operation of installing an electric wire onto a wire holder.
Figure 5B:
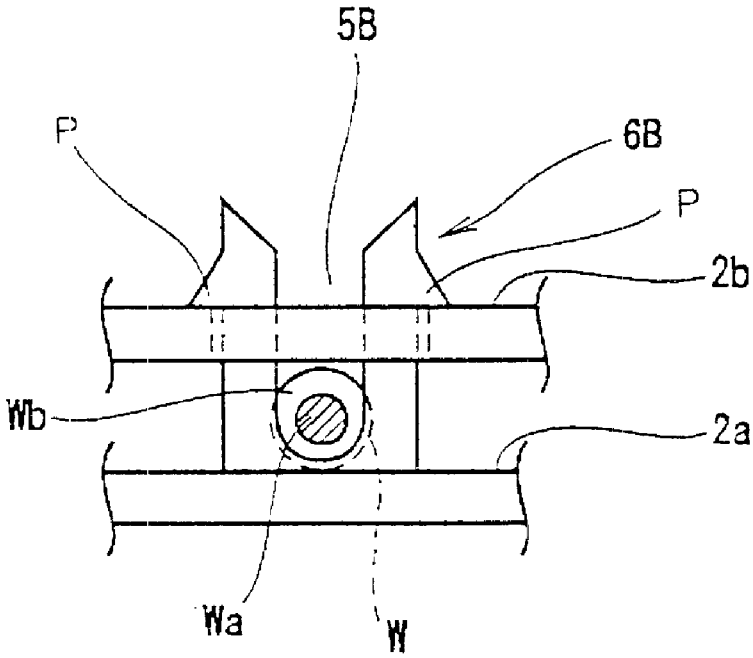

A width L1 of the slot 5A in the insulation displacement terminal 6A (FIG. 4A) is set to be smaller than a width L2 of the slot 5B in the wire holder 6B (FIG. 5A). As shown in FIG. 4B, an inner edge of the slot 5A bites into an insulation sheath Wb of the electric wire W until its edges come into contact with a core element Wb of the electric wire W. On the other hand, as shown in FIG. 5B, inner edges of the slot 5B bites slightly into an insulation sheath Wb of the electric wire W but the edges do not come into contact with the core element Wb of the electric wire W.

The cover plate member 2*b* is provided with receiving apertures 7 in fixed positions corresponding to the respective insulation displacement terminals 6A and wire holders 6B when the cover plate member 2*b* is folded over the base plate member 2*a* with respect to the foldable section 4, as shown in FIG. 1.

A width 7*a* of each receiving aperture 7 is substantially the same as a thickness La of each of the insulation displacement terminals 6A and the wire holders 6B. A length 7*b* of each receiving aperture 7 is shorter than a distance Lb between the lock projections P of the insulation displacement terminals 6A and wire holders 6B. Consequently, a pair of elements on opposite sides of each slot 5A (5B) are deflected inwardly when the lock projections P come into contact with longitudinal opposite ends of the receiving apertures 7. When the lock projections P pass through the receiving apertures 7, the pair of elements return outwardly and the lock projections P engage the periphery of the aperture 7, thereby preventing the cover plate member 2*b* from separating from the base plate member 2*a*.

The ground terminal 3 is formed by cutting the conductive plate 2 from a central portion of the central foldable section 4 of the cover plate member 2*b*. The ground terminal 3 is connected to the base plate member 2*a* at the proximal end thereof. The ground terminal 3 projects from the central foldable section 4 when the cover plate member 2*b* is folded over the base plate member 2*a* with respect to the central foldable section 4.

Figure 2:
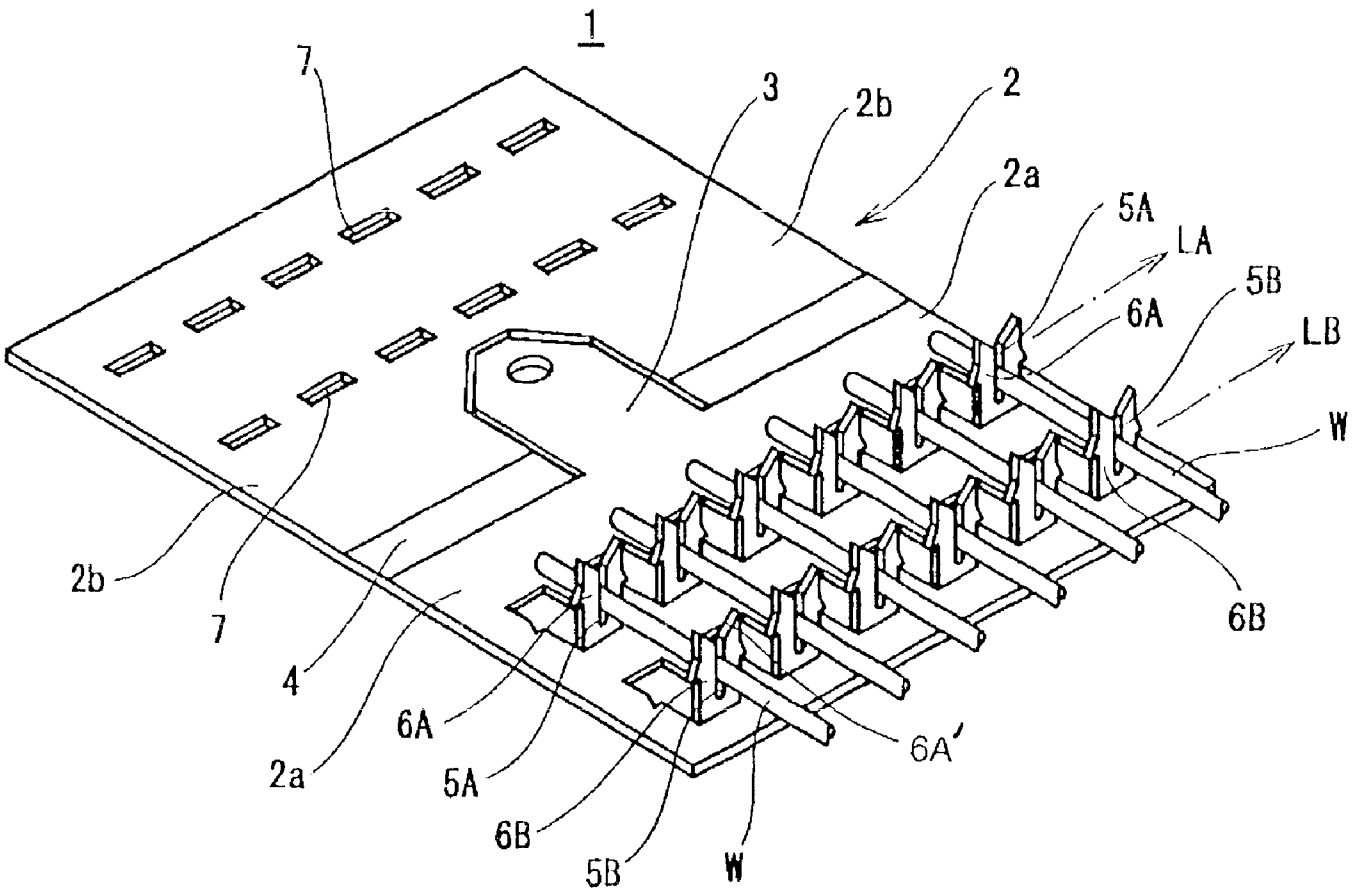
FIG. 2 is a perspective view of the ground connector shown in FIG. 1, illustrating electric wires positioned on the connector.

A method for connecting electric wires W to the ground connector 1 will be described below. First, as shown in FIG. 2, each electric wire W is positioned above the slots 5A and 5B in the insulation displacement terminal 6A and wire holder 6B which are arranged in series. The electric wire W is placed on the enlarged inlet of each of the slots 5A and 5B during this positioning step.

Figure 3:
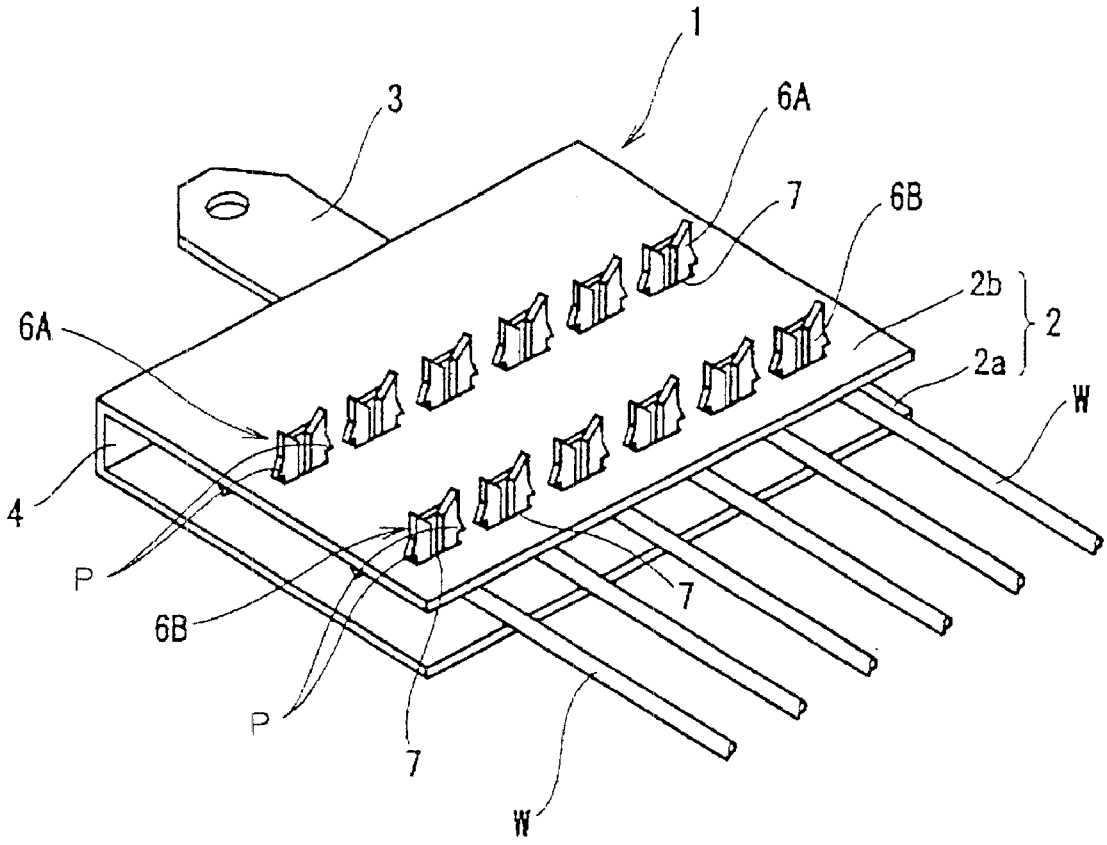
FIG. 3 is a perspective view of the ground connector shown in FIG. 1, illustrating the electric wires which are brought into insulation displacement connection in the connector.

Second, as shown in FIG. 3, the foldable section 4 is folded so that the insulation displacement terminals 6A and wire holders 6B enter the corresponding receiving apertures 7. This step is simultaneously carried out for all of the insulation displacement terminals and wire holders.

When inserting the insulation displacement terminals 6A and wire holders 6B into the receiving apertures 7, the lid plate member 2*b* is opposite the base plate member 2*a*, thereby pushing the electric wires W into the slots 5A and 5B. When the cover plate member 2*b* comes into contact with the lock projections P of the insulation displacement terminals 6A and wire holders 6B, the pairs of elements opposite the slots are deflected inwardly to reduce their gaps, since the length 7*b* of the receiving aperture 7 is shorter than the outer distance Lb between the opposite lock projections P.

Since the width of slot 5A in the insulation displacement terminal 6A is narrow and the width of the slot 5B in the wire holder 6B is wide, as mentioned above, the inner edges of the slot 5A in the insulation displacement terminal 6A bite into the insulation sheath Wb of the electric wire W and come into contact with the core element Wa of the electric wire W (FIG. 4B). On the other hand, the inner edge of the slot 5B in the wire holder 6B bites slightly into the insulation sheath Wb of the electric wire W but it does not come into contact with the core element Wa of the electric wire W (FIG. 5B).

When the lock projections P pass through the receiving aperture 7, the lock projections P return outwardly and engage the periphery of the aperture 7, thereby pressing the electric wires W by the lid plate member 2*b*.

Thus, the ground connector 1 in the above embodiment of the present invention can connect the electric wires W to the insulation displacement terminals 6A and simultaneously hold the wires W in the wire holders 6B by positioning the electric wires on the terminals and holders and folding the conductive plate 2 with respect to the foldable section 4. Since the connector bites into the insulation sheath of each electric wire at two positions, the electric wire can be firmly held in the connector and can be prevented from coming out of the connector.

Alternatively, the wire holder 6B may have the same configuration as that of the insulation displacement terminal 6A. In this case, insulation displacement connection is applied to the electric wire at two positions, thereby enhancing reliability of the electrical connection.

Figure 6:
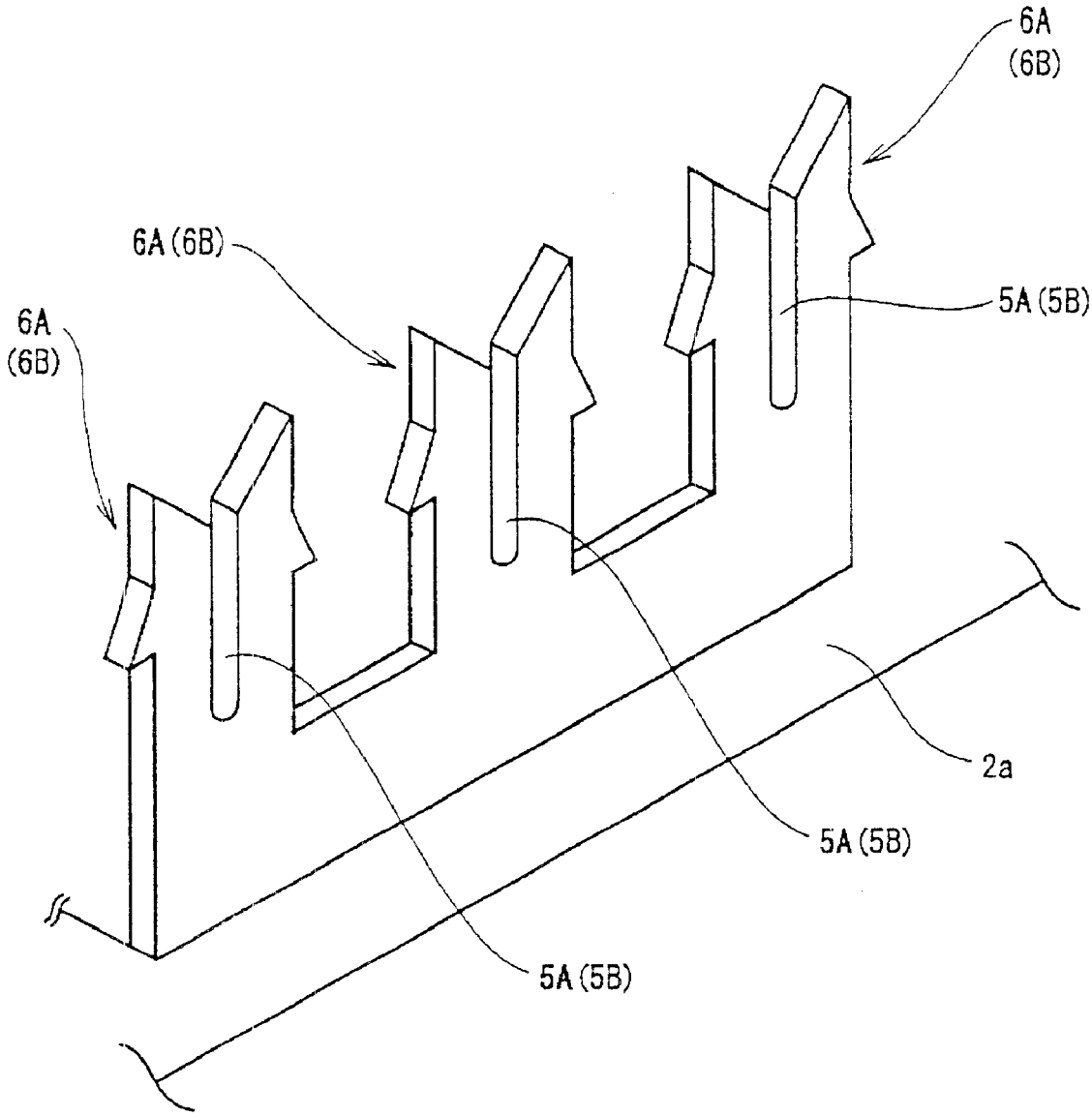
FIG. 6 is a perspective view of a modification of the insulation displacement terminals.

Although each of the insulation displacement terminals 6A and wire holders 6B are cut and raised independently in the above embodiment, in another modification, a plurality of insulation displacement terminals and/or a plurality of wire holders may be cut and raised jointly, as shown in FIG. 6.

In the case where the conductive plate is made of a high conductive resin material, the insulation displacement terminals and wire holders may be formed in a standing position beforehand.

Figure 7:
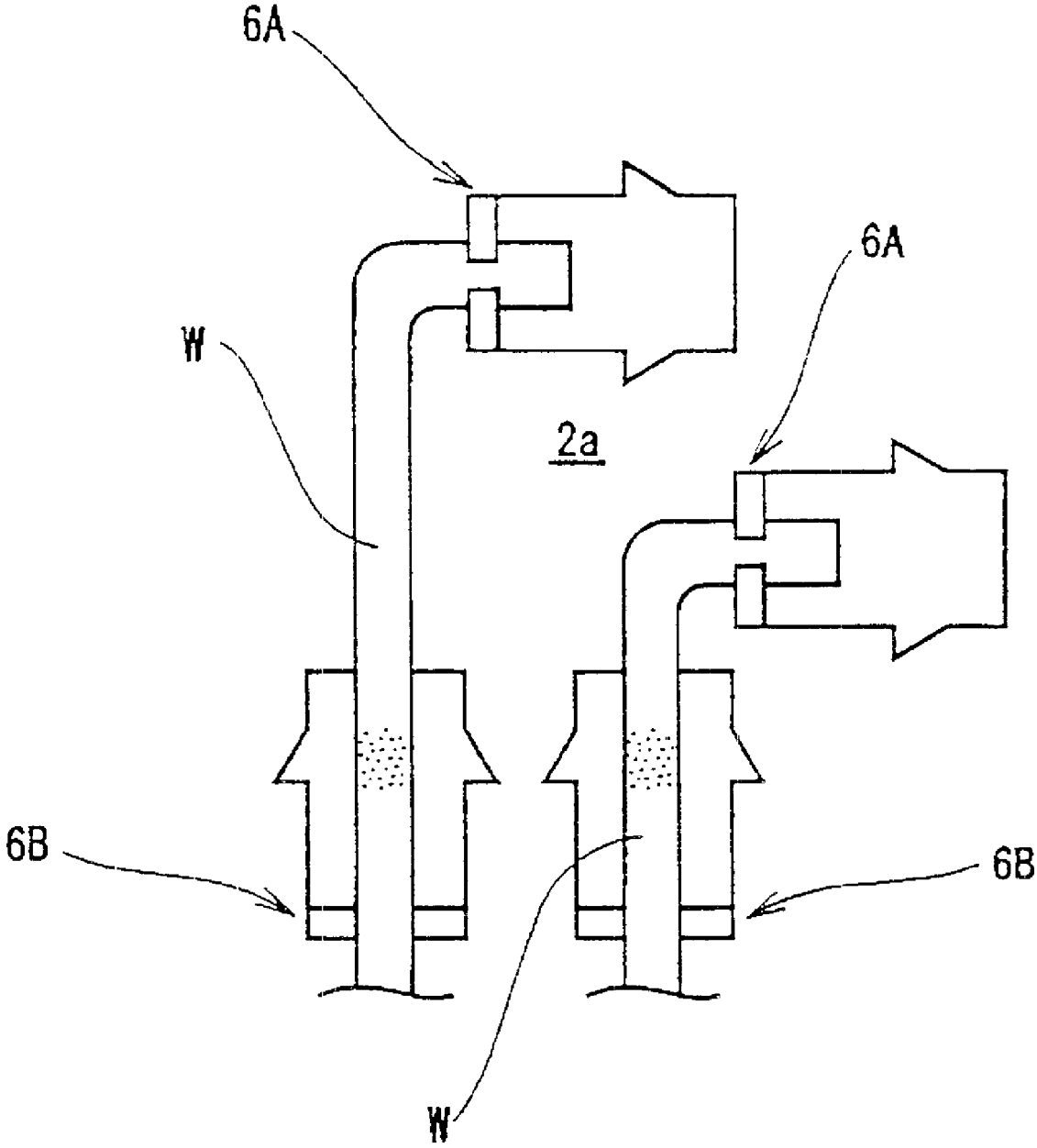
FIG. 7 is a perspective view of a further modification of insulation displacement terminals.
Figure 8:
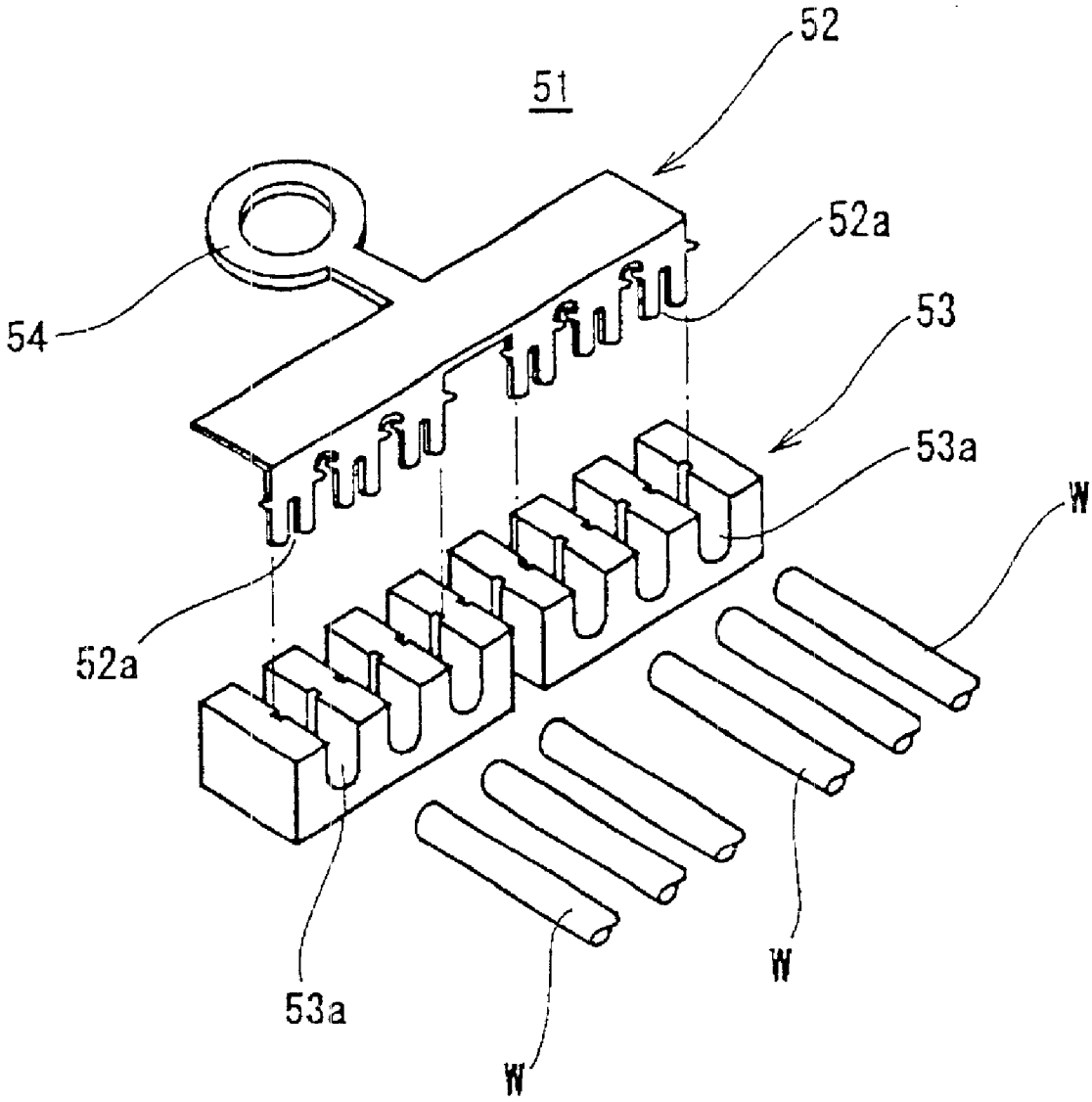
FIG. 8 PRIOR ART
FIG. 8 is a perspective view of a conventional ground connector.
Figure 9:
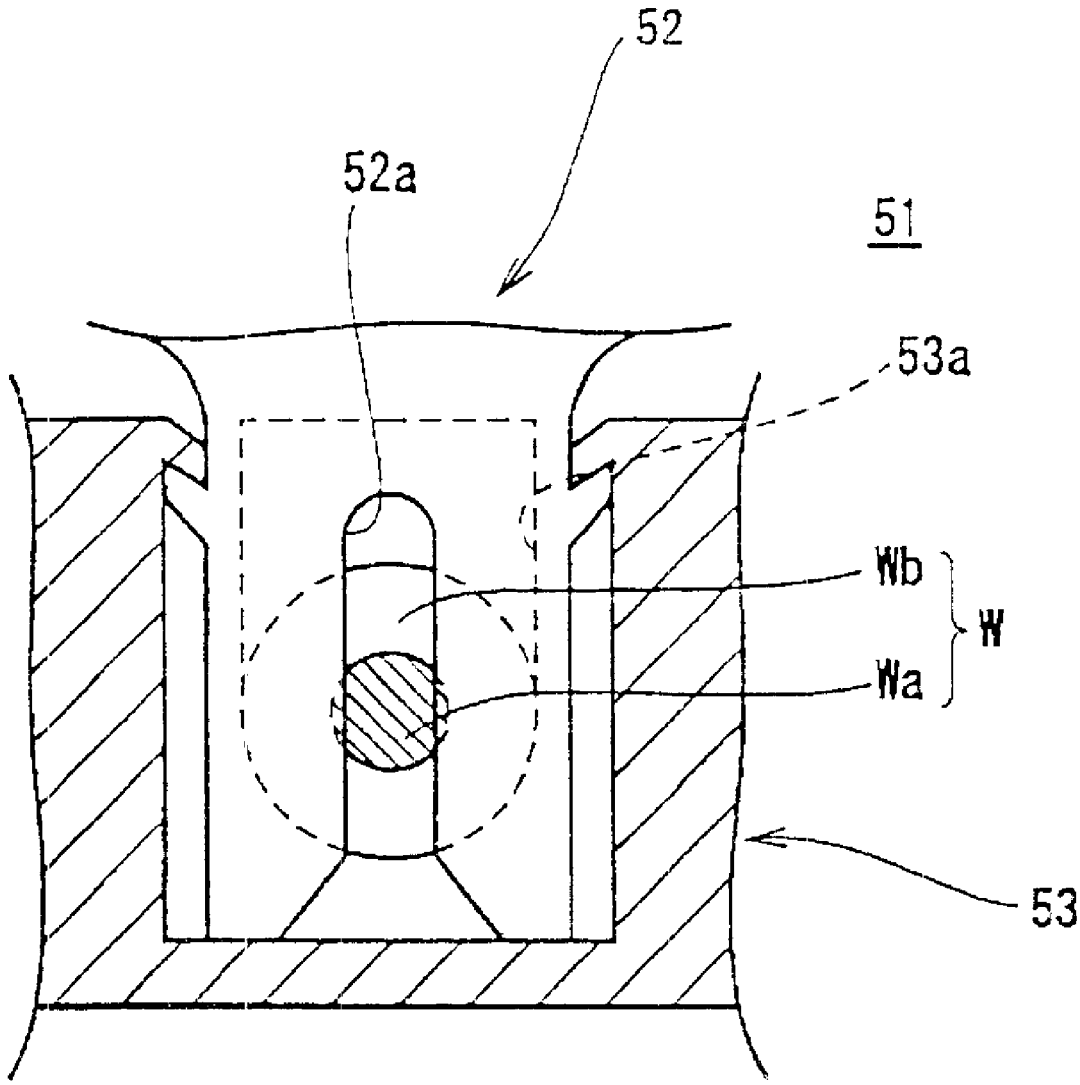
FIG. 9 PRIOR ART
FIG. 9 is a cross sectional view of the conventional ground connector, illustrating an electric wire in insulation displacement connection onto the connector.

As shown in FIG. 7, an insulation displacement terminal 6A and a wire holder 6B may not necessarily be arranged on a straight line but at other positions such as on a 90 degree-angled line. This arrangement can enhance prevention of inadvertent removal of the electric wires from the connector. From the above description of the invention, those skilled in the art will perceive improvements, changes and modifications. Such improvements, changes and modifications are within the level of skill in the art are intended to be encompassed by the appended claims.

The entire disclosure of Japanese Patent Application No. 2000-310147, filed on Oct. 11, 2000, is incorporated herein by reference in its entirety.

What is claimed is:

1. A ground connector by which a plurality of electric wires for a ground circuit are connected together to a ground at their ends;

said ground connector comprising a conductive flat plate having a first side section, a second side section, a central foldable section between said first and second side sections, and a ground terminal, said first side section configured to serve as a base plate member, said second side section configured to serve as a cover plate member that presses the electric wires when said conductive flat plate is folded with respect to said central foldable section;

said base plate member including a plurality of insulation displacement terminals formed unitarily and in one piece therewith, said cover plate member including a plurality of receiving apertures each corresponding to each of said insulation displacement terminals;

wherein the electric wires are positionable on said insulation displacement terminals, said cover plate member is foldable over said base plate member with respect to said central foldable section so that said insulation displacement terminals can enter the respective receiving apertures, to thereby connect the electric wires to respective insulation displacement terminals.

2. A ground connector according to claim 1, wherein said base plate member further includes a plurality of wire holders each corresponding to and spaced from a respective one of said insulation displacement terminals;

wherein each wire holder has substantially the same configuration as that of each insulation displacement terminal; and wherein said cover plate member is provided with a plurality of receiving apertures corresponding to said insulation displacement terminals and said wire holders.

3. A ground connector according to claim 1, wherein said insulation displacement terminals are formed by cutting and raising given portions of said conductive plate.

4. A ground connector according to claim 2, wherein said insulation displacement terminals and said wire holders are formed by cutting and raising given portions of said conductive plate, each insulation displacement terminal is disposed in series with each corresponding wire holder and said insulation displacement terminals and wire holders are juxtaposed, respectively.

5. A ground connector according to claim 1, wherein said ground terminal is formed by cutting a central portion of said central foldable section, said ground terminal is connected to said base plate member at the proximal end thereof, said ground terminal projects from said central foldable section when said cover plate member is folded over said base plate member with respect to said central foldable section.

6. A ground connector according to claim 2, wherein said ground terminal is formed by cutting a central portion of said central foldable section, said ground terminal is connected to said base plate member at the proximal end thereof, said ground terminal projects from said central foldable section when said cover plate member is folded over said base plate member with respect to said central foldable section.

* * * * *

UNITED STATES PATENT AND TRADEMARK OFFICE

CERTIFICATE OF CORRECTION

PATENT NO. : 6,551,129 B2
DATED : April 22, 2003
INVENTOR(S) : K. Kato

It is certified that error appears in the above-identified patent and that said Letters Patent is hereby corrected as shown below:

Column 5,
Line 58, "ends;" should be -- ends, --

Column 6,
Line 1, "comprising" should be -- comprising: --.
Line 21 after "terminals" insert the following"

-- ; and wherein said insulation displacement terminals are provided through their upper ends with wire insertion slots forming a pair of spaced apart elements which define each of said wire insertion slots, said elements including lock projections on opposite outer side surfaces, said insulation displacement terminals being insertable into said receiving apertures while deflecting said lock projections inwardly, so that inner peripheral edges of said slots in said insulation displacement terminals can come into contact with core elements of the electric wires upon deflection of said elements of said insulation displacement terminals while inner peripheral edges of said slots in said wire holders can bite slightly into sheaths of the electric wires to hold the electric wires --

Signed and Sealed this

Twenty-third Day of December, 2003

JAMES E. ROGAN
*Director of the United States Patent and Trademark Office*